US005921594A

United States Patent [19]

Bendel

[11] Patent Number: 5,921,594

[45] Date of Patent: Jul. 13, 1999

[54] MOTOR-VEHICLE DOOR LATCH WITH CHILD-SAFETY CUTOUT

[75] Inventor: Thorsten Bendel, Oberhausen, Germany

[73] Assignee: Kiekert AG, Heiligenhaus, Germany

[21] Appl. No.: 08/928,378

[22] Filed: Sep. 12, 1997

[30] Foreign Application Priority Data

Sep. 21, 1996 [DE] Germany ..... 196 38 700

[51] Int. Cl.[6] ..... E05C 3/06

[52] U.S. Cl. ..... 292/216; 292/DIG. 65

[58] Field of Search ..... 292/201, 144, 292/216, DIG. 65, DIG. 62

[56] References Cited

U.S. PATENT DOCUMENTS

| | | | |
|---|---|---|---|
| 4,492,395 | 1/1985 | Yamada | 292/216 |
| 4,518,181 | 5/1985 | Yamada | 292/201 |
| 5,419,596 | 5/1995 | Okada et al. | 292/201 |
| 5,443,292 | 8/1995 | Shimada et al. | 292/341.16 |
| 5,680,783 | 10/1997 | Kuroda | 70/277 |
| 5,715,713 | 2/1998 | Aubry et al. | 70/277 |
| 5,718,465 | 2/1998 | Dowling et al. | 292/216 |

FOREIGN PATENT DOCUMENTS 2 073 299 10/1981 United Kingdom .

*Primary Examiner*—Darnell M. Boucher
*Assistant Examiner*—John B. Walsh
*Attorney, Agent, or Firm*—Herbert Dubno; Andrew Wilford

[57] ABSTRACT

A motor-vehicle door latch has an input lever pivotal by an inside door handle about an axis and an output lever connected to the latch mechanism and pivotal about the axis between an actuated position corresponding to a door-unlatched position and an unactuated position corresponding to a latched position. The input lever is formed with a straight slot extending radially of the axis and the output lever is formed with an L-shaped slot having one leg extending generally radially of the axis and alignable with the slot of the input lever and another leg. A wheel can rotate about an axis generally parallel to the lever axis and is formed with an arcuate slot slidably receiving one end of a coupling rod having another end engaged in both of the slots of the levers so that, when the other end is engaged in a coupling position in the one leg offset from the other leg, the two levers are rotationally coupled together by the other end and, when the other end is engaged in a decoupling position of the rod in the other leg, the levers can pivot limitedly relative to each other. A spring bearing on the rod urges it into the coupling position. A drive can rotate the wheel into the off position and thereby pull the rod into the decoupling position and also can rotate the wheel into the on position and thereby free the rod for movement by the spring into the coupling position.

5 Claims, 3 Drawing Sheets

MOTOR-VEHICLE DOOR LATCH WITH CHILD-SAFETY CUTOUT

FIELD OF THE INVENTION

The present invention relates to a motor-vehicle door latch. More particularly this invention concerns such a latch having a child-safety cutout.

BACKGROUND OF THE INVENTION

A motor-vehicle door latch normally has a housing, a lock fork on the housing engageable with a door bolt and pivotable between a holding position engaged around the bolt and retaining it on the housing and a freeing position permitting the door bolt to move into and out of the housing, and a release pawl engageable with the fork and displaceable between a latched position retaining the fork in the holding position and an unlatched position unengageable with the fork and permitting the fork to move into the freeing position. An actuating mechanism is movable between an actuated position and an unactuated position and normally has an inside and an outside actuating lever connected to respective door handles.

Such a system is often provided with a child-safety cutout which allows the inside door handle to be disconnected. Thus if a child accidentally or intentionally actuates the inside handle, the door will not open. The child-safety on position is often set remotely, by actuation of a switch on the dashboard, and is effected in the latch by an electric motor or actuator.

As described in British patent document 2,073,299 filed Mar. 27, 1980 by M. Kogyo a problem with such a latch is that if an attempt is made to turn on the child-safety feature while the latch is open and/or actuated, such setting will fail. In other words the user will, for instance, push the button to turn on the child-safety feature but, because one door is still open or being closed, the setting will not be effected in that door. Obviously such a situation can lead to an accident, just the type of accident the child-safety feature is intended to prevent.

OBJECT OF THE INVENTION

It is therefore an object of the present invention to provide an improved motor-vehicle door latch with a child-safety cutout.

Another object is the provision of such an improved motor-vehicle door latch with a child-safety cutout which overcomes the above-given disadvantages, that is which is of simple and robust construction and where the child-safety on position can be set even when the latch itself is actuated.

SUMMARY OF THE INVENTION

A motor-vehicle door latch has according to the invention a latch mechanism operable between a door-latched and a door-unlatched position, an input lever connectable to an inside door handle and pivotal thereby about an axis between an actuated and an unactuated position, and an output lever connected to the latch mechanism and pivotal about the axis between an actuated position corresponding to the door-unlatched position and an unactuated position corresponding to the door-latched position. One of the levers is formed with an elongated and generally straight slot extending generally radially of the axis and the other of the levers is formed with an L-shaped slot having one leg extending generally radially of the axis and alignable with the slot of the one lever and another leg extending transversely of the one leg. A child-safety actuating wheel can rotate about an axis generally parallel to the lever axis between an on position and an off position and is formed with an arcuate slot generally centered on the wheel axis. A coupling rod has one end seated and slidable in the arcuate slot of the wheel and another end engaged in both of the slots of the levers so that, when the other end is engaged in a coupling position of the rod in the one leg of the slot of the other lever offset from the other leg, the two levers are rotationally coupled together by the other end and, when the other end is engaged in a decoupling position of the rod in the other leg of the slot of the other lever, the two levers can pivot limitedly relative to each other with movement of the other end along the other leg. According to the invention a spring bearing on the rod urges the other rod end into the coupling position. A drive connected to the wheel rotates it into the off position and thereby pulls the rod into the decoupling position and also rotates the wheel into the on position and thereby frees the rod for movement by the spring into the coupling position.

Thus with this system when the wheel is moved into the child-safety off position it pulls the rod positively and sets this position, regardless of the position of the input and output levers. When the wheel is moved into the on position it merely frees the rod to move down into the coupling position under the force of the spring so that, if the levers are positioned such that they impede this movement, the spring will continue to bear on the rod and once the levers move into positions allowing the rod to move into the coupling position, this movement will take place.

The output lever is L-shaped and has one arm formed with the respective slot and another arm connected to the mechanism.

The spring is a torque spring mounted on the axis of the wheel.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
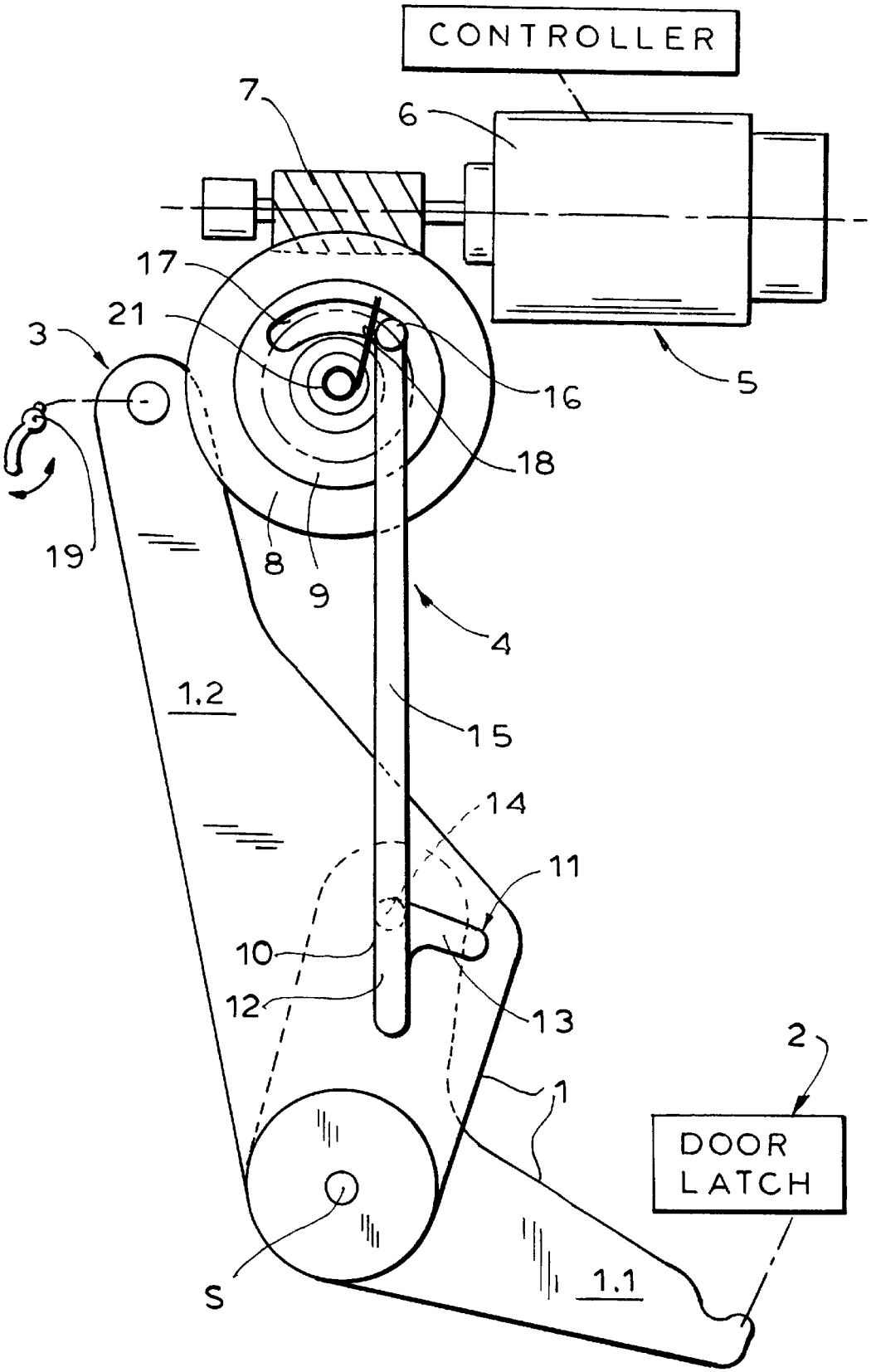
FIG. 1 is a large-scale partly diagrammatic view of the latch system of this invention with the child-safety cutout in the on position.

As seen in FIG. 1 a motor-vehicle door latch 2 is connected through a lever system 1 at 3 to an inside door handle or level 19 so that, when a child-safety mechanism 4 is in the illustrated off position, actuation of the handle 19 operates the latch 2. U.S. Pat. No. 5,653,484 and U.S. Pat. No. 5,667,263 and the patent art cited therein describe a mechanism usable as the latch 2.

According to the invention a drive 5 operated by an electronic controller 20 comprises a reversible electrical motor 6 whose output is a worm gear 7 meshing with a gear 8 fixed to an output wheel 9 mounted on a pivot or axle 21. The lever assembly 1 comprises an L-shaped or two-arm lever 1.1 connected to the door latch 2 and pivoted at S and a simple lever or arm 1.2 also pivoted at S and connected to the handle 19. The lever 1.1 is formed with a straight slot formation 10 extending generally radially of the pivot axis S while the lever 1.2 is formed with an L-shaped slot formation 11 having one leg 12 which can be aligned parallel to the axis S with the slot 10 and another leg 13 which extends transversely from an outer end of the leg 12.

A coupling rod 15 has one end 14 engaged in the slots 10 and 11 and an opposite end 16 engaged in a circularly arcuate slot 17 of the wheel 9. A torque spring 18 engaged around the axle 21 of the wheel 9 urges the end 16 clockwise and, therefore, urges the rod 15 downward.

Figure 2:
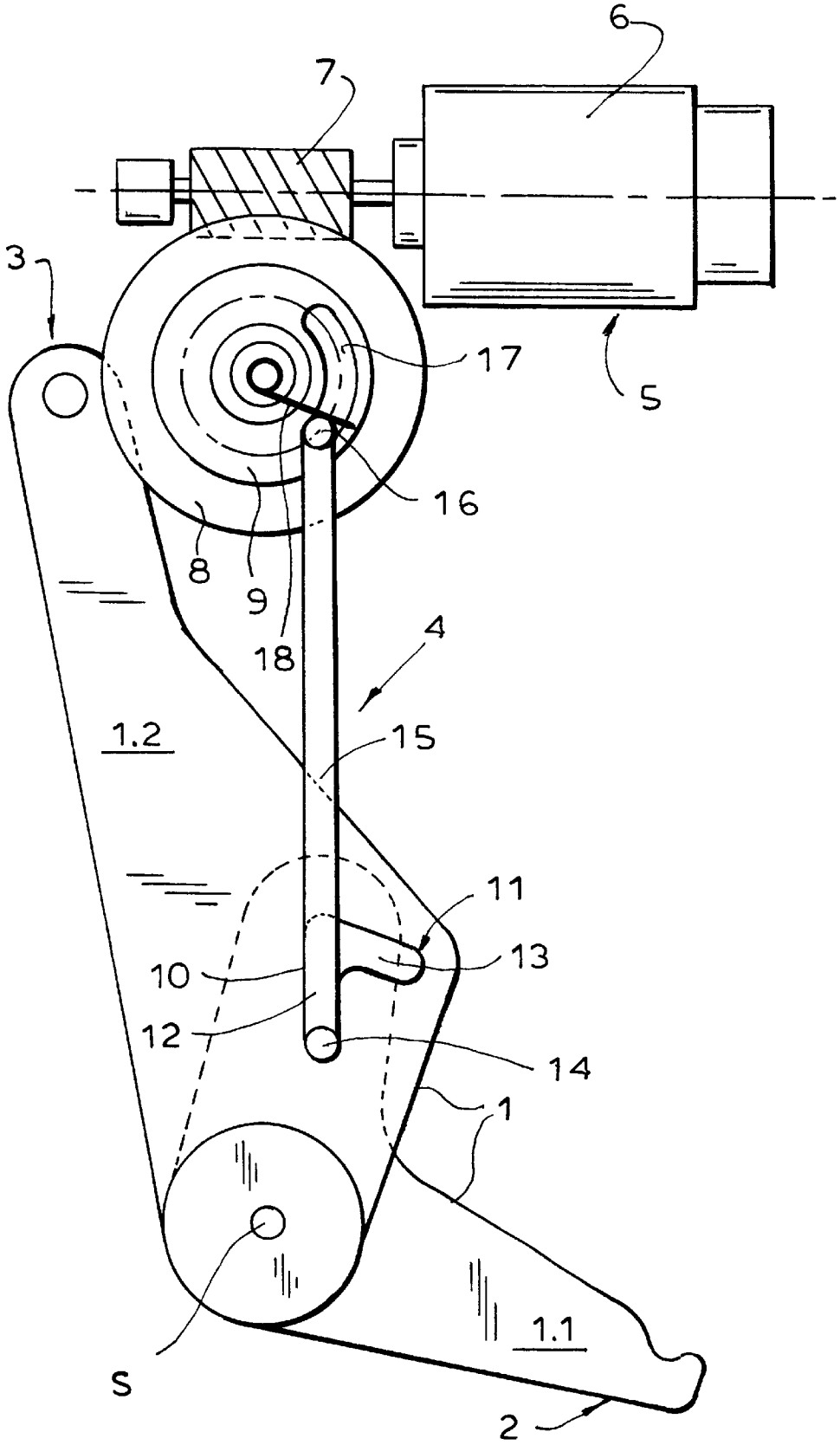
FIGS. 2 and 3 are views like FIG. 1 but with the cutout in the off and the off-stored positions, respectively.
Figure 3:
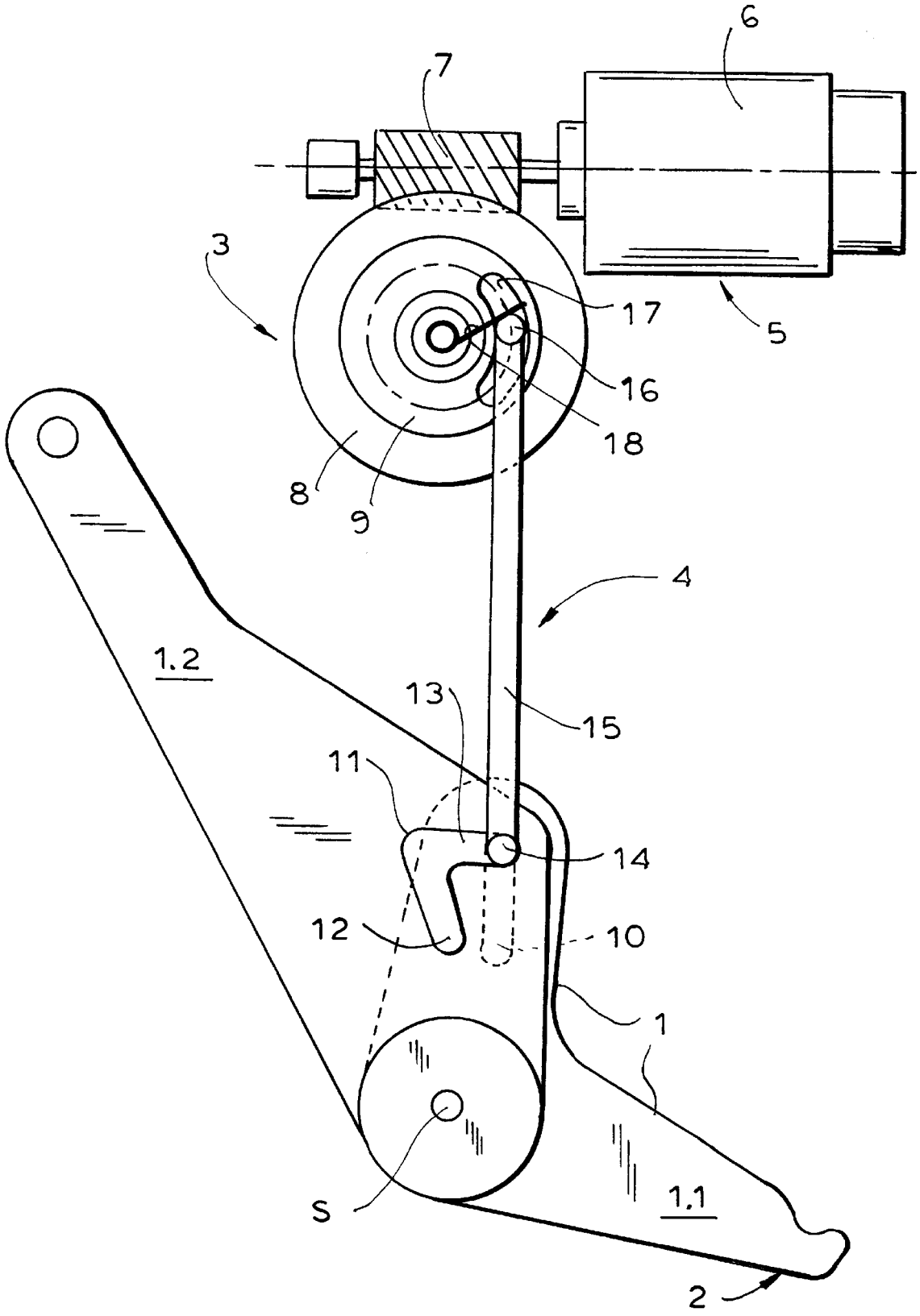

The motor 6 is operated by the controller 20 to rotate the wheel 9 through about 90° between the FIG. 1 on position and the positions of FIGS. 2 and 3. The spring 18 urges the rod 15 continuously into the below-described coupling position so that whenever the wheel 9 moves clockwise, the spring 18 will push down the rod 15 provided, of course, nothing is blocking such movement of this rod 15.

In the on position of the child-safety mechanism 4 illustrated in FIG. 1, actuation of the lever 19 to pivot the lever 1.2 counterclockwise will have no effect on the lever 1.1 since the rod end 14 will simply slide along the slot leg 13. In effect the two levers 1.1 and 1.2 are decoupled from each other.

In the off position illustrated in FIG. 2, however, the rod end 14 is in its end coupling position at the inner end of the slot 10 and of the leg 12. Thus counterclockwise pivoting of the lever 1.2 will be transmitted to the lever 1.1 to open the latch 2. The two levers 1.1 and 1.2 are coupled rotationally together.

If, however, the motor 6 puts the wheel 9 in the on position as shown in FIG. 3, but the rod end 14 is still resident in the outer end of the slot leg 13 because the lever 1.2 remains actuated, the rod 15 will be unable to move downward out of its decoupling position into its coupling position. Instead the wheel 9 will move fully into the on position but the rod 15 will hang up, with loading of the spring 18. As soon, however, as the lever arm 1.2 is returned to its unactuated position, aligning the slot leg 12 with the slot 10 of the lever 11, the rod end 14 will be able to move down into the FIG. 2 coupling position. Thus if the wheel 9 is moved into the child-safety on position while the lever 1.2 is actuated, as soon as the lever 1.2 is released the on position will be set.

I claim:

1. A motor-vehicle door latch comprising:

a latch mechanism operable between a door-latched and a door-unlatched position;

an input lever connectable to an inside door handle and pivotal thereby about an axis between an actuated and an unactuated position;

an output lever connected to the latch mechanism and pivotal about the axis between an actuated position corresponding to the door-unlatched position and an unactuated position corresponding to the door-latched position, one of the levers being formed with a generally straight slot extending generally radially of the axis and the other of the levers being formed with an L-shaped slot having one leg extending generally radially of the axis and alignable with the straight slot and another leg extending transversely of the one leg;

a child-safety actuating wheel rotatable about an axis generally parallel to the lever axis between an on position and an off position and formed with an arcuate slot generally centered on the wheel axis;

a coupling rod having one end seated and displaceable along the arcuate slot of the wheel and another end engaged in both of the slots of the levers and displaceable between an end coupling position engaged in the one leg of the L-shaped slot offset from the other leg thereof to rotationally couple together the levers and a decoupling position engaged in the other leg of the slot of the other lever and permitting limited relative pivoting of the levers with movement of the other end along the other leg;

spring means braced between the wheel and the rod and urging the other rod end angularly into one of the end positions; and drive means connected to the wheel for rotating it into the off position and thereby pulling the rod into the other end position and for rotating the wheel into the on position and thereby freeing the rod for movement by the spring means into the one end position.

2. The motor-vehicle door latch defined in claim 1 wherein the output lever is L-shaped and has one arm formed with the respective slot and another arm connected to the mechanism.

3. The motor-vehicle door latch defined in claim 1 wherein the spring is a torque spring mounted on the axis of the wheel.

4. The motor-vehicle door latch defined in claim 1 wherein the one end position is the coupling position.

5. A motor-vehicle door latch comprising:

a latch mechanism operable between a door-latched and a door-unlatched position;

a straight input lever connectable to an inside door handle and pivotal thereby about an axis between an actuated and an unactuated position;

an L-shaped output lever connected to the latch mechanism and pivotal about the axis between an actuated position corresponding to the door-unlatched position and an unactuated position corresponding to the door-latched position, the output lever being formed with a generally straight slot extending generally radially of the axis, the input lever being formed with an L-shaped slot having one leg extending generally radially of the axis and align able with the straight slot and another leg extending transversely of the one leg;

a child-safety actuating wheel rotatable about an axis generally parallel to the lever axis between an on position and an off position and formed with an arcuate slot generally centered on the wheel axis;

a coupling rod having one end seated and displaceable along the arcuate slot of the wheel and another end engaged in both of the slots of the levers and displaceable between an end coupling position engaged in the one leg of the L-shaped slot offset from the other leg thereof to rotationally couple together the levers and a decoupling position engaged in the other leg of the slot of the other lever and permitting limited relative pivoting of the levers with movement of the other end along the other leg;

a spring braced between the wheel and the rod urging the other rod end angularly into the coupling position; and drive means including a motor having a rotary output carrying a worm gear meshing with the wheel for rotating the wheel into the off position and thereby pulling the rod into the decoupling position and for rotating the wheel into the on position and thereby freeing the rod for movement by the spring into the coupling position.

* * * * *